US008899856B2

(12) United States Patent
Limongi et al.

(10) Patent No.: US 8,899,856 B2
(45) Date of Patent: Dec. 2, 2014

(54) COSMETIC APPLICATOR

(75) Inventors: Michel Limongi, Clichy (FR); Gaël Thorez, Montigny le Bretonneux (FR); Benoît Kellal, Paris (FR)

(73) Assignee: Albea Services, Gennevilliers (FR)

( * ) Notice: Subject to any disclaimer, the term of this patent is extended or adjusted under 35 U.S.C. 154(b) by 475 days.

(21) Appl. No.: 13/383,305

(22) PCT Filed: Jul. 9, 2010

(86) PCT No.: PCT/EP2010/059937

§ 371 (c)(1),
(2), (4) Date: Jan. 10, 2012

(87) PCT Pub. No.: WO2011/004024

PCT Pub. Date: Jan. 13, 2011

(65) Prior Publication Data

US 2012/0114408 A1 May 10, 2012

(30) Foreign Application Priority Data

Jul. 10, 2009 (EP) ..... 09009076

(51) Int. Cl.

| | |
|---|---|
| ***A45D 40/24*** | (2006.01) |
| ***A45D 34/04*** | (2006.01) |
| ***A45D 33/12*** | (2006.01) |
| ***A45D 40/26*** | (2006.01) |

(52) U.S. Cl.

CPC ..... *A45D 40/24* (2013.01); *A45D 40/261* (2013.01); *A45D 34/041* (2013.01); *A45D 33/12* (2013.01)

USPC ..... 401/29; 401/21; 401/32; 401/117; 401/208

(58) Field of Classification Search

CPC ..... A45D 33/12; A45D 34/04; A45D 34/041; A45D 40/26; A45D 40/261

USPC ..... 401/6, 21, 29, 32, 117, 197, 208, 218, 401/219, 220; 15/230.11

See application file for complete search history.

(56) References Cited

U.S. PATENT DOCUMENTS 339,529 A * 4/1886 Cranston ..... 401/208
1,853,697 A * 4/1932 Oliver ..... 132/297

(Continued)

OTHER PUBLICATIONS

European Search Report completed Mar. 15, 2010 (EP09009076).

(Continued)

*Primary Examiner* — David Walczak
*Assistant Examiner* — Joshua Wiljanen
(74) *Attorney, Agent, or Firm* — Banner & Witcoff, Ltd.

(57) ABSTRACT

An applicator (10) for applying a cosmetic product onto a person's skin, the applicator (10) comprising a first handle component (12) and an application arrangement (14) connected to the first handle component (12). The application arrangement (14) comprises at least two application elements (16.1, 16.2) that can be loaded with cosmetic product, each of which can be brought selectively into contact with the person's skin to apply the cosmetic product. In an embodiment, the application arrangement (14) is rotatably fitted to a distal end (18) of the first handle component, (12) thereby allowing a user to select which application element (16.1, 16.2) is to be loaded with cosmetic product for application to the person's skin. In an embodiment, each application element (16.1, 16.2) is rotatably fitted to a support, which in turn is rotatably fitted to the distal end (18) of the first handle component (12), the rotating application element facilitating the loading and application of the cosmetic product.

18 Claims, 7 Drawing Sheets

(56) References Cited

U.S. PATENT DOCUMENTS

| | | | | |
|---|---|---|---|---|
| 1,953,911 | A | 4/1934 | Parkin | |
| 2,523,683 | A | 9/1950 | De Mario | |
| 3,409,929 | A * | 11/1968 | Fisher | 15/248.2 |
| 7,153,053 | B1 | 12/2006 | Wiley | |
| 2005/0020948 | A1 | 1/2005 | Gueret | |
| 2006/0275072 | A1 | 12/2006 | Petit | |
| 2007/0143964 | A1 * | 6/2007 | Mittermeyer | 16/344 |
| 2009/0188065 | A1 * | 7/2009 | Major | 15/230.11 |

OTHER PUBLICATIONS

International Preliminary Report on Patentability Chapter I, mailed on Jan. 19, 2012 (PCT/EP2010/059937).

International Search Report mailed Sep. 21, 2010 (PCT/EP2010/059937); ISA/EP.

* cited by examiner

B
106.1
54,90
46,50
108
102
B
6,50

Ø10
R7.75
18
0,25
20
15,50
17,85

COUPE B-B
ECHELLE 1 : 1
3
2,40
5,37
124
122
DÉTAIL A
ECHELLE 4 : 1

102.1
102.2
DÉTAIL E
ECHELLE 5 : 1
106.1

106.2
E
102
COUPE C-C
ECHELLE 1 : 1

0,35
0,75
106.1
15,50
C
C
108
100
106.1
106.2
102
108

106.1
102
108

DETAIL D
ECHELLE 5 : 1

COSMETIC APPLICATOR

CROSS-REFERENCE TO RELATED APPLICATIONS

The present application is a U.S. National Phase filing of International Application No. PCT/EP2010/059937 filed on Jul. 9, 2010, designating the United States of America and claiming priority to European patent application No. 09009076.2, filed Jul. 10, 2009. The present application claims priority to and the benefit of all the above-identified applications, and all the above-identified applications are incorporated by reference herein in their entireties.

FIELD OF INVENTION

This invention relates to an applicator for a cosmetic product, such as foundation.

BACKGROUND TO THE INVENTION

Application of cosmetic foundation requires even distribution across an application area, typically a person's skin. Currently, cosmetic compacts containing foundation are sold with individual flat sponges. To apply foundation, a user rubs a side of the sponge against a cosmetic foundation product to load the sponge with the product. The user then pats or rubs the sponge onto the skin to distribute the product.

Such an application process suffers from numerous drawbacks. For example, the sponge surface is often not loaded with product in an even manner, causing either too much or too little product to be deposited onto the skin during application. This results in varying foundation coverage of the skin, which is undesirable. Furthermore, patting or rubbing the sponge against the skin does not provide enough precision and/or pressure to effectively transfer the product onto the skin.

It has been found that a rolling type applicator, such as the one disclosed in US patent application no. US2006275072, provides an improved application means. Such an applicator works well for applying a single cosmetic product, but not for applying a plurality of cosmetic products. It is known that to achieve a unified complexion and to fix the product onto the skin, professional makeup artists use a variety of other products before applying foundation.

Thus, there exists a need for an application tool that can apply a plurality of cosmetic products, such as a primer, foundation and/or finishing powder. Currently, a different application tool is used for each type of cosmetic product. However, such a solution is expensive, as it requires the manufacture and purchase of a plurality of application tools. Multiple application tools are also inconvenient as they take up space and lead to larger and heavier compact cases. Alternatively, a single application tool may be used, but its drawback is that it requires cleaning between applications of different products. This is also inconvenient since it complicates the application process for the user.

OBJECT OF THE INVENTION

It is therefore an aim of the present invention to provide a cosmetic product applicator that can address the shortcomings of existing foundation applicators described above.

SUMMARY OF THE INVENTION

In accordance with a first aspect of this invention there is provided an applicator for applying a cosmetic product onto a person's skin, the applicator comprising:

a first handle component; and an application arrangement connected to the first handle component, the application arrangement comprising at least two application elements that can be loaded with cosmetic product, each of which can be brought selectively into contact with the person's skin to apply the cosmetic product.

In an embodiment, the application arrangement is rotatably fitted to a distal end of the first handle component, thereby allowing a user to select which application element is to be loaded with cosmetic product for application to the person's skin.

In an embodiment, each application element is rotatably fitted to a support, which in turn is rotatably fitted to the distal end of the first handle component, the rotating application element facilitating the loading and application of the cosmetic product.

In an embodiment, the applicator comprises a locking member for fixing the application arrangement relative to the first handle component, while the user is loading and applying cosmetic product to one of the application elements.

In an embodiment, the locking member comprises a sleeve defining a second handle component, the application arrangement being movable from a first position, in which only one of the application elements protrudes from the sleeve for loading and application of the cosmetic product, with the remaining application elements being accommodated within the sleeve so as to fix the application arrangement relative to the first handle component, to a second position in which the application arrangement protrudes from the sleeve to allow the application arrangement to be rotated relative to the first handle component.

In an embodiment of the invention, the application arrangement comprises a pair of application elements.

In an alternate embodiment of the invention, the application arrangement comprises three application elements.

According to a second aspect of the invention there is provided an applicator package for a cosmetic product, the applicator package comprising:

a container for storing at least one type of cosmetic product; and an applicator for applying a cosmetic product onto a person's skin, the applicator comprising:

a first handle component; and an application arrangement connected to the first handle component, the application arrangement comprising at least two application elements that can be loaded with cosmetic product, each of which can be brought selectively into contact with the person's skin to apply the cosmetic product.

According to a third aspect of the invention there is provided an application arrangement for a cosmetic product applicator, the application arrangement comprising:

an axle assembly for allowing the application arrangement to be rotatably fitted to a handle component, the axle assembly terminating in a pair of end supports; and at least two application elements that can be loaded with cosmetic product, the at least two application elements being rotatably fitted to the end supports.

In accordance with a third aspect of this invention there is provided an applicator for applying a cosmetic product onto a person's skin, the applicator comprising:

a housing;

an application arrangement accommodated within the housing, the application arrangement comprising at least two application elements that can be loaded with cosmetic product, each of which can be brought selectively into contact with the person's skin to apply the cosmetic product; and an actuator to move the application arrangement from a retracted position, in which at least one of the application elements is accommodated within the housing, and an extended position in which the at least two application elements protrudes from the housing.

In an embodiment, in the retracted position, only one of the application elements protrudes from the housing for loading and application of the cosmetic product, with the remaining application elements being accommodated within the housing so as to fix the application arrangement relative to the housing.

In an embodiment, the application arrangement comprises:

a support structure slidably accommodated within the housing; and an application element holder rotatably fitted to a distal end of the support structure.

In an embodiment, the application elements are rotatably connected to the application element holder, so that in the extended position, the application elements can rotate relative to the housing.

In an embodiment, the support structure comprises a push button that protrudes through an aperture defined in a side wall of the housing, the push button defining the actuator to move the application arrangement between the retracted position and the extended position.

In an embodiment of the invention, the application arrangement comprises a pair of application elements.

In an alternate embodiment of the invention, the application arrangement comprises three application elements.

DESCRIPTION OF PREFERRED EMBODIMENTS

Referring first to FIGS. 1 to 8, an applicator 10 for applying a cosmetic product onto a person's skin is shown. The applicator 10 comprises a first handle component 12 and an application arrangement 14 connected to the first handle component 12. In this embodiment, the application arrangement 14 comprises a pair of application elements 16.1 and 16.2, each of which can be loaded with cosmetic product (not shown) and brought selectively into contact with the person's skin so as to apply the cosmetic product.

Figure 1:
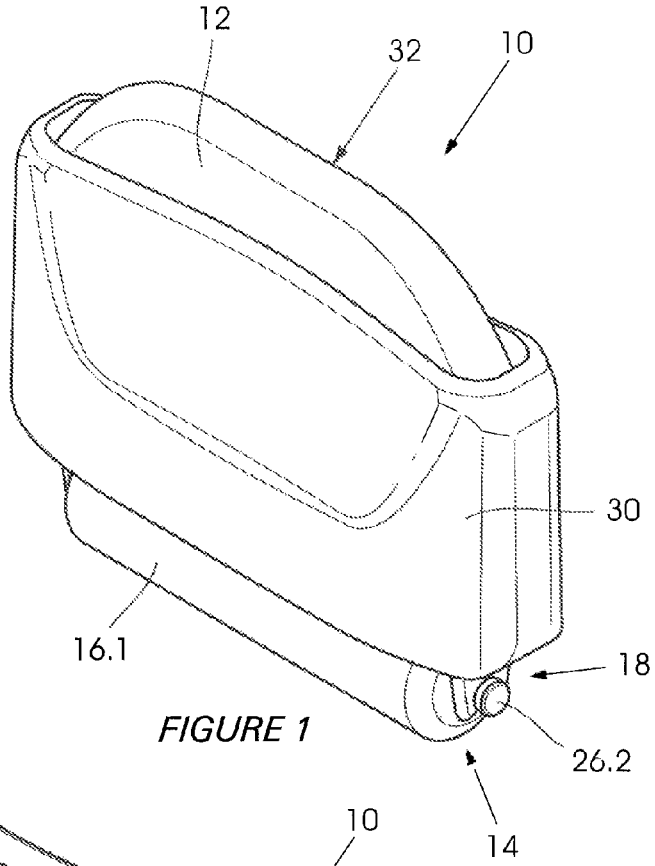
FIG. 1 shows a perspective view of a cosmetic product applicator according to a first embodiment, the applicator being shown in a first position in which an application element protrudes from a sleeve, ready for loading and applying cosmetic product.
Figure 2:
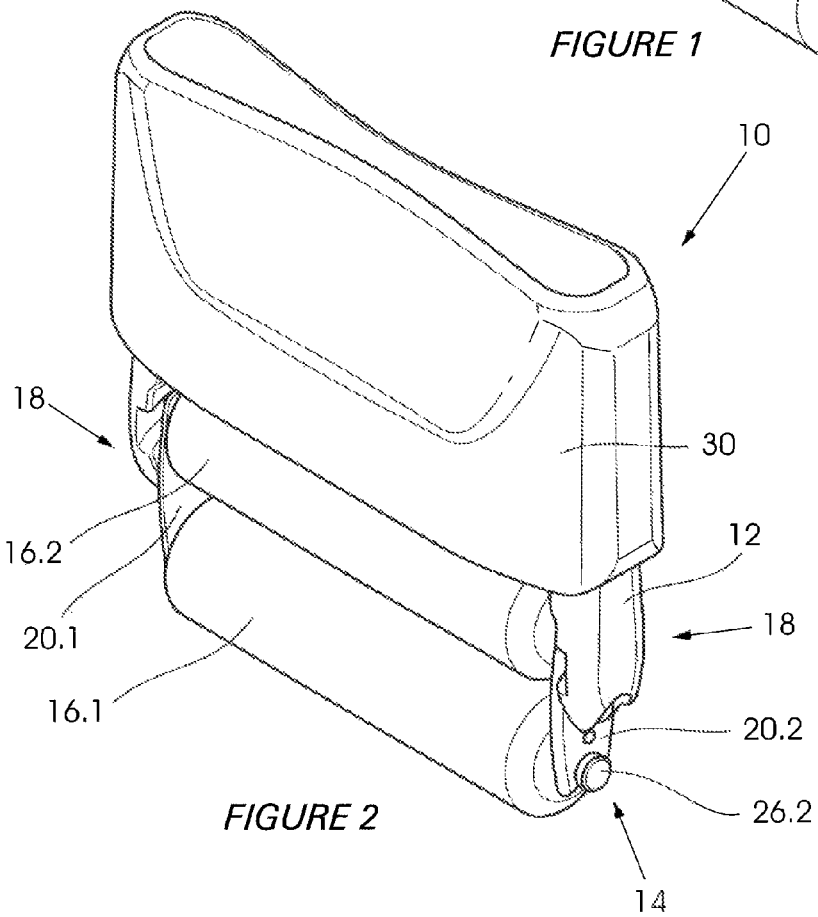
FIG. 2 shows the cosmetic product applicator of FIG. 1 in a second position, in which an application arrangement protrudes from the sleeve to allow the application arrangement to be rotated.
Figure 3:
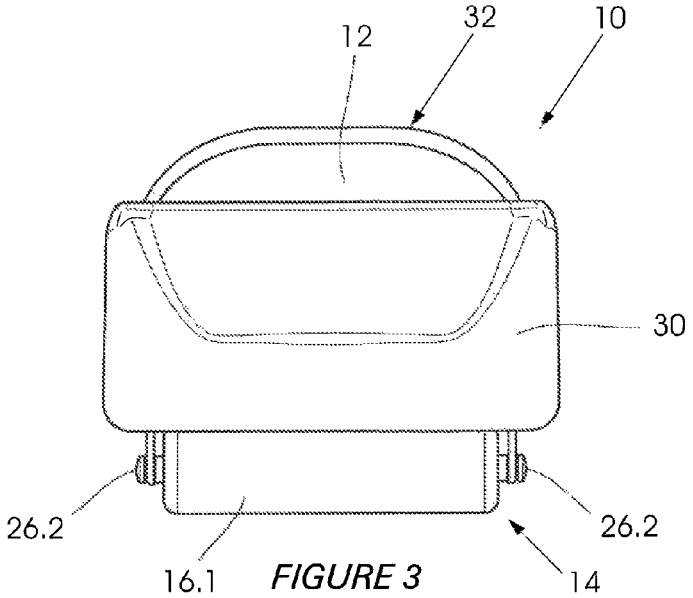
FIGS. 3 and 4 show front views of the cosmetic product applicator shown in FIGS. 1 and 2, respectively.
Figure 4:
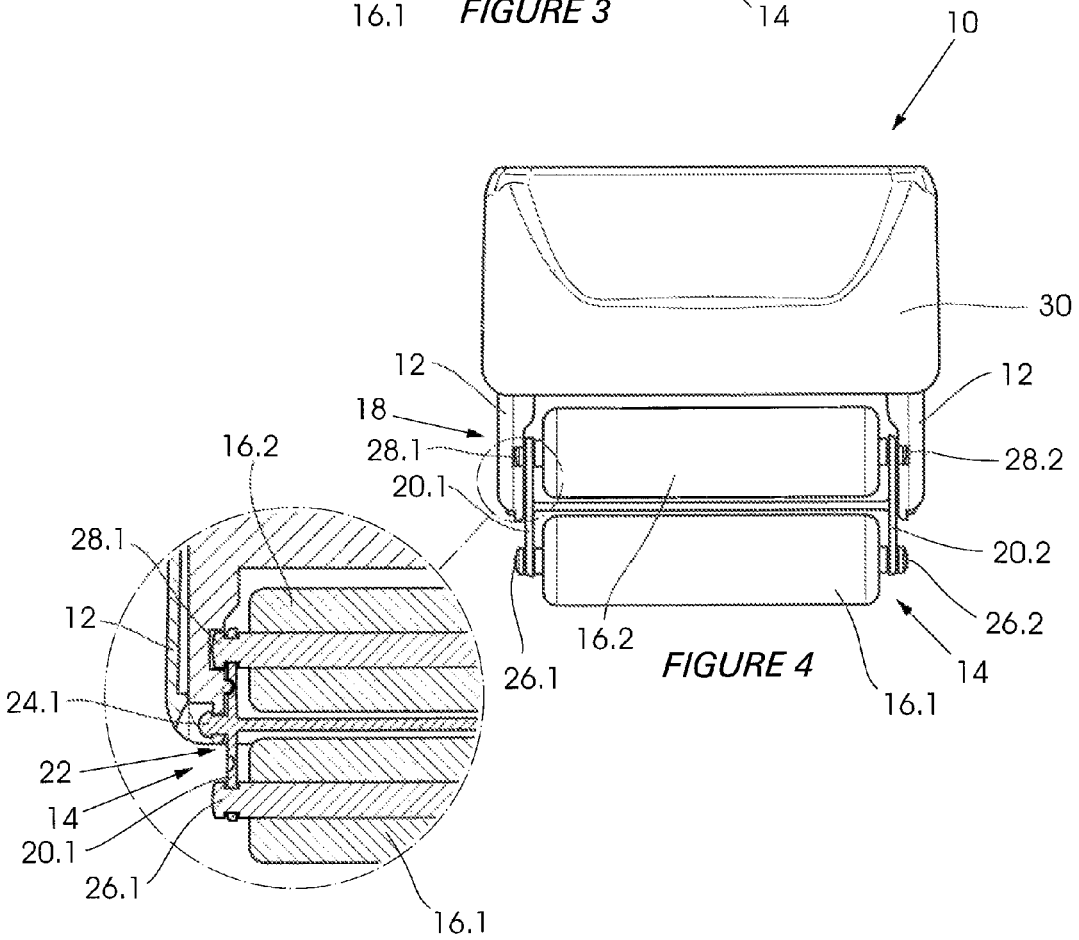
Figure 5:
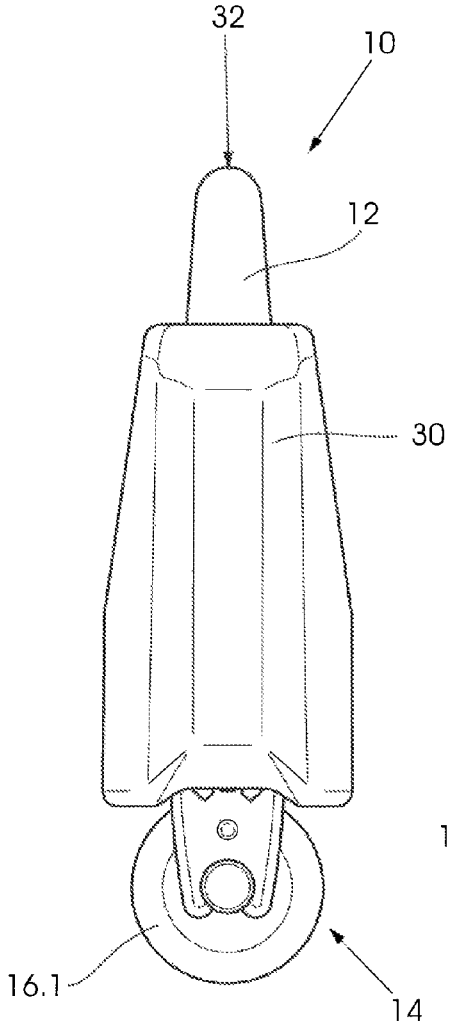
FIGS. 5 and 6 show side views of the cosmetic product applicator shown in FIGS. 1 and 2, respectively.
Figure 6:
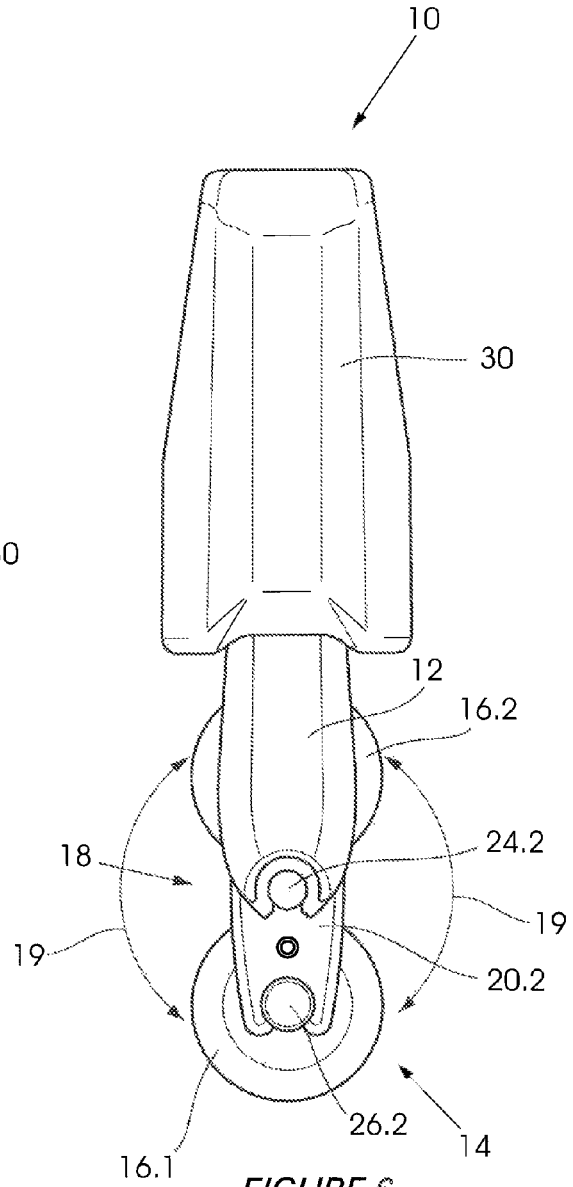
Figure 7:
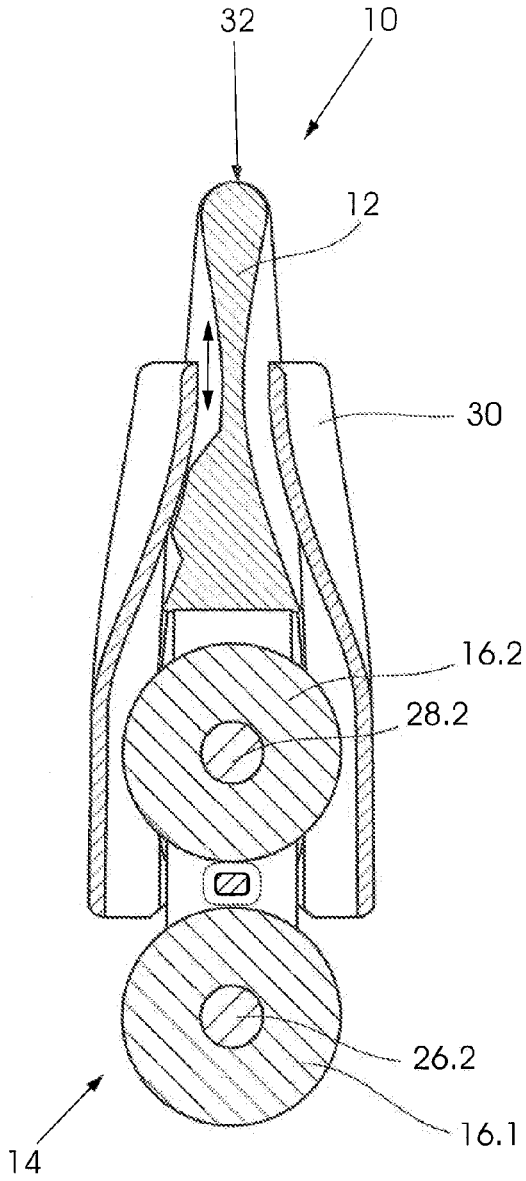
FIGS. 7 and 8 show cross-sectional views of the side views shown in FIGS. 5 and 6.
Figure 8:
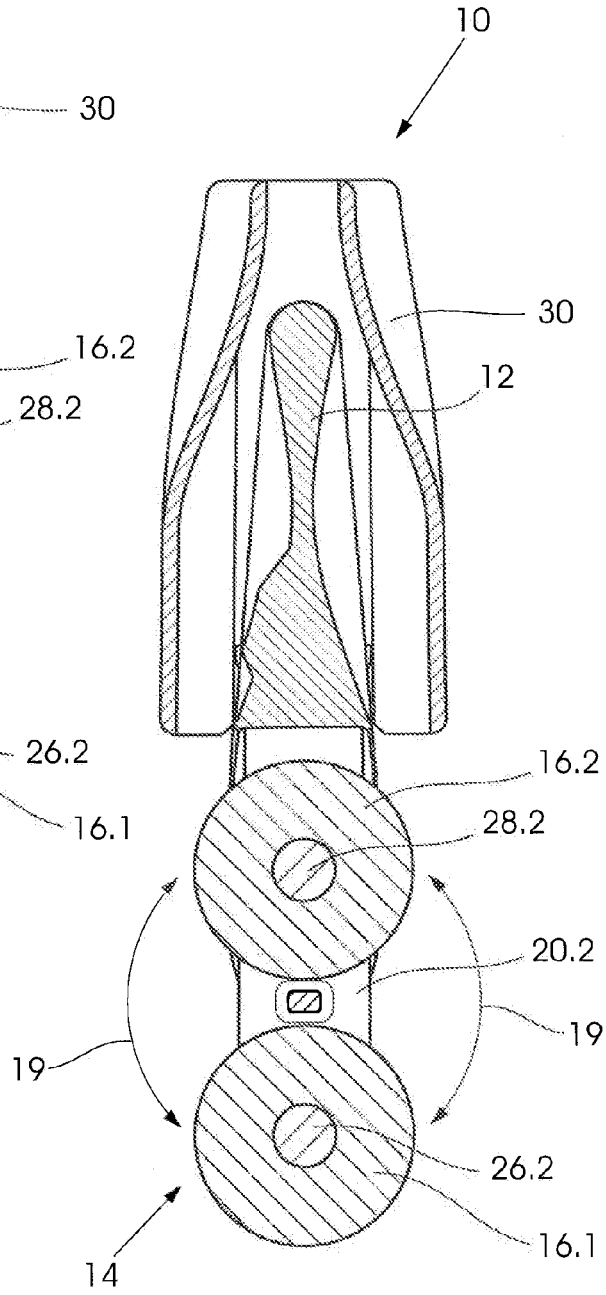

In an embodiment, the application arrangement 14 is rotatably fitted to a distal end 18 of the first handle component 12, as indicated by arrows 19 in FIGS. 6 and 8. This allows a user to select which application element 16.1, 16.2 to be loaded with cosmetic product for application to the person's skin. In an embodiment of the invention, the application arrangement 14 includes end supports 20.1, 20.2, between which a primary axle assembly 22 extends. The primary axle assembly 22 terminates in stub axles 24.1, 24.2, which can freely rotate within complementary recesses defined in the distal ends 18 of the first handle component so as to define a primary axis of rotation.

In the embodiment illustrated in FIGS. 1 to 8, the application elements 16.1, 16.2 are located on opposite sides of the primary axle assembly 22, so as to be spaced apart by 180° from each other.

Each application element 16.1, 16.2 is in turn rotatably fitted to the end supports 20.1, 20.2, which in turn, as described above, are rotatably fitted to the distal ends 18 of the first handle component 12. The rotating application elements 16.1, 16.2 facilitate the loading and application of the cosmetic product. In an embodiment of the invention, each application element 16.1, 16.2 terminates in end secondary stub axles 26.1, 26.2 and 28.1 and 28.2, respectively. The end secondary stub axles 26.1, 26.2 and 28.1 and 28.2 are in turn rotatably accommodated within apertures or recesses defined in the end supports 20.1, 20.2. The application elements 16.1, 16.2 are thus rotatable around secondary axes defined by the stub axles 26.1, 26.2 and 28.1 and 28.2.

Since the application arrangement 14 is rotatably fitted to the distal end 18 of the first handle component 12, it is necessary to lock or fix the application arrangement 14 relative to the first handle component 12. This facilitates the loading of cosmetic product onto one of the application elements 16.1, 16.2, and for the subsequent application of the cosmetic product from the application elements 16.1, 16.2 onto the person's skin.

In an embodiment, a sleeve 30 is provided to fix the application arrangement 14 relative to the first handle component 12. The sleeve 30 thus defines a second handle component that can be held by a user of the applicator 10. In this embodiment, the application arrangement 14 is movable from a first position, shown in FIGS. 1, 3, 5 and 7, to a second position, shown in FIGS. 2, 4, 6 and 8, by manually manipulating a proximal end 32 of the first handle component 12 while holding the sleeve 30.

In the first position, only one of the application elements, in this case element 16.1, protrudes from the sleeve 30 for loading and application of the cosmetic product. In this position, the remaining application elements, in this case element 16.2, is accommodated within the sleeve 30 so as to fix the application arrangement 14 relative to the first handle component 12.

In the second position, the application arrangement 14 protrudes from the sleeve 30. This allows the application arrangement 14 to be rotated relative to the first handle component 12, as indicated by arrows 19 in FIGS. 6 and 8, which in turn allows different cosmetic products to be loaded and applied using another application element.

In an embodiment of the invention, each of the application elements 16.1, 16.2 comprises a roller covered by a suitable application material, such as sponge or a flocked surface, for facilitating application of the cosmetic product onto the skin. The characteristics of the application material are chosen according to the viscosity/thixotropy of the cosmetic product used, in order to provide adequate loading and transfer during application. In particular, the application material is chosen to provide desired results in terms of dosing quality, metering efficiency, product film thickness at application time.

Examples of application materials suitable include: NBR, SBR and EPDM sponges.

It is envisaged that the application elements would be replaceable, especially if they comprise sponge material as these get dirty with time and filled with product, thereby losing their ability to absorb and deposit product. Additional materials for the application elements 16.1, 16.2 include, but are not limited to, foam, non-woven materials and felt. It is further envisaged that in one version, the application material may be pre-loaded with product, to be used as a sampler, for example.

In use, each application element 16.1, 16.2 is typically loaded with a different cosmetic product and then applied as need be, for example, sequentially. Professional makeup artists, for example, apply powder on top of creamy foundation so as to set the foundation. In this case, the first application element, such as sponge, could be used to load and deposit foundation, while a second application element (not necessarily a sponge, but having a flocked surface, for example) could be used to load and deposit a thin layer of powder. Another possibility would be to charge the first application element with a so-called 'primer', which is a creamy product that evens out the skin by filling in the pores, and to then load the second application element with the foundation.

Figure 9:
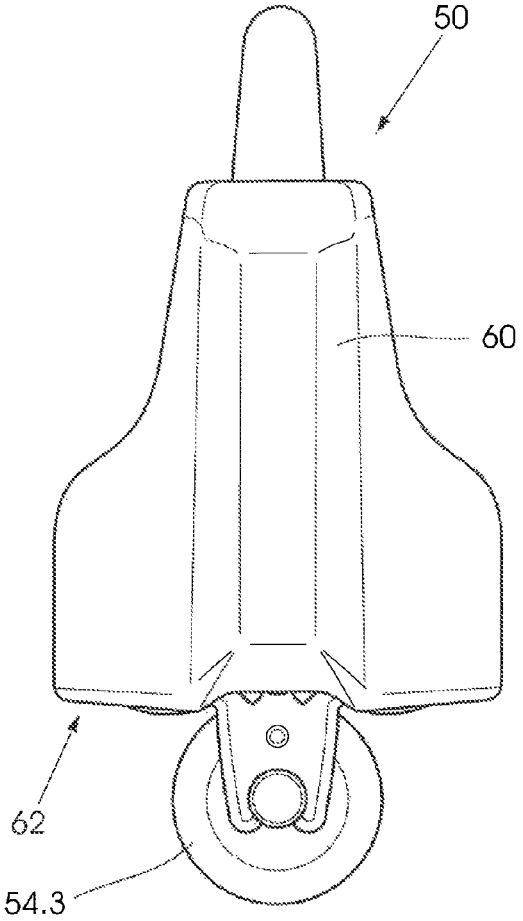
FIGS. 9 and 10 show side views of two positions of a cosmetic product applicator according to a second embodiment.
Figure 10:
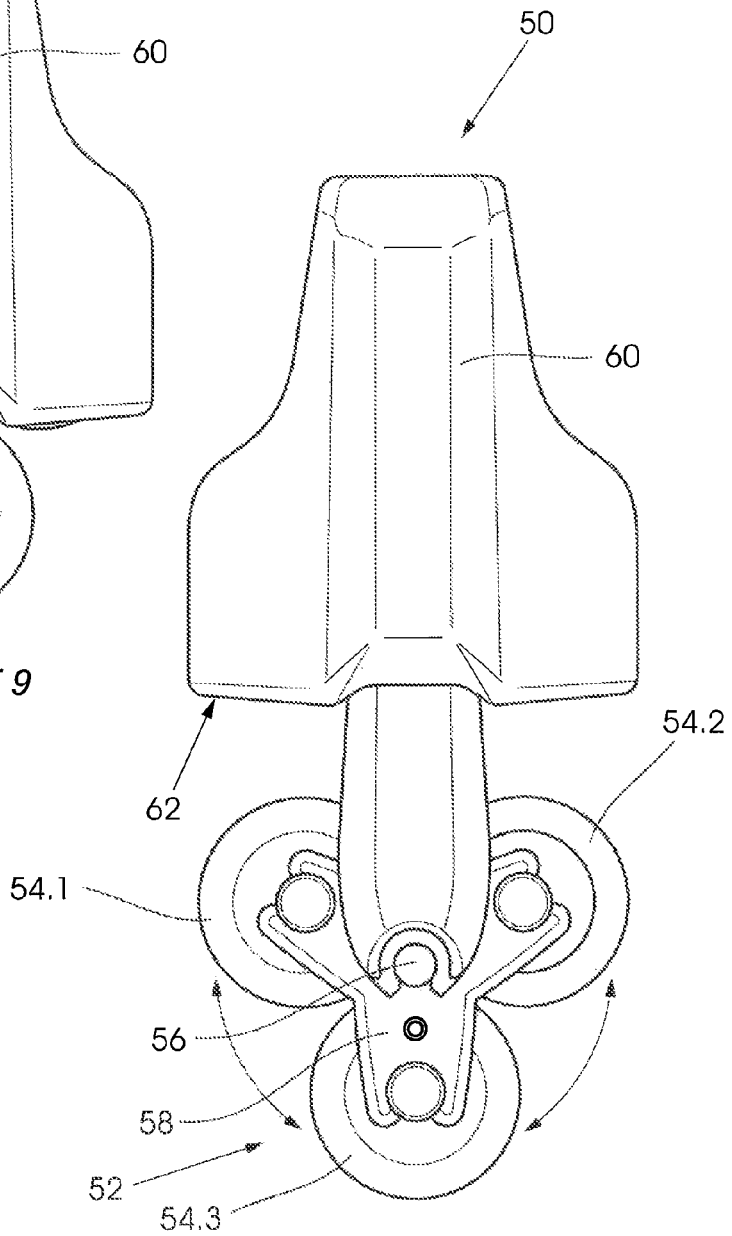

Turning now to FIGS. 9 and 10, in an alternate cosmetic product applicator 50, the application arrangement 52 comprises 3 application elements, 54.1, 54.2 and 54.3 spaced apart by 120° radially around the primary axle assembly 56. To accommodate the 3 application elements 54.1, 54.2 and 54.3, the end supports 58 that rotatably accommodate the application arrangement 52 comprise 3 prongs. In addition, the sleeve 60 that accommodates the application arrangement 52 in the first position shown in FIG. 9 has a flared bottom section 62.

This applicator 50 however operates substantially the same as the applicator 10 described above with reference to FIGS. 1 to 8, and will thus not be described in more detail here. For example, this triple applicator 50 may be used to deposit a primer, followed by a foundation and, finally, a powder.

Turning now to FIGS. 11 to 21, according to a third aspect of this invention, a cosmetic applicator 100 comprises a housing 102 and an application arrangement 104 accommodated within the housing 102. In the illustrated embodiment, the application arrangement 104 comprises two application elements 106.1, 106.2. As described above, each application element 106.1, 106.2 can be loaded with cosmetic product and then brought selectively into contact with a person's skin to apply the cosmetic product.

Figures 11, 12, 14, 15, 16, 17, 18, 19, 20:
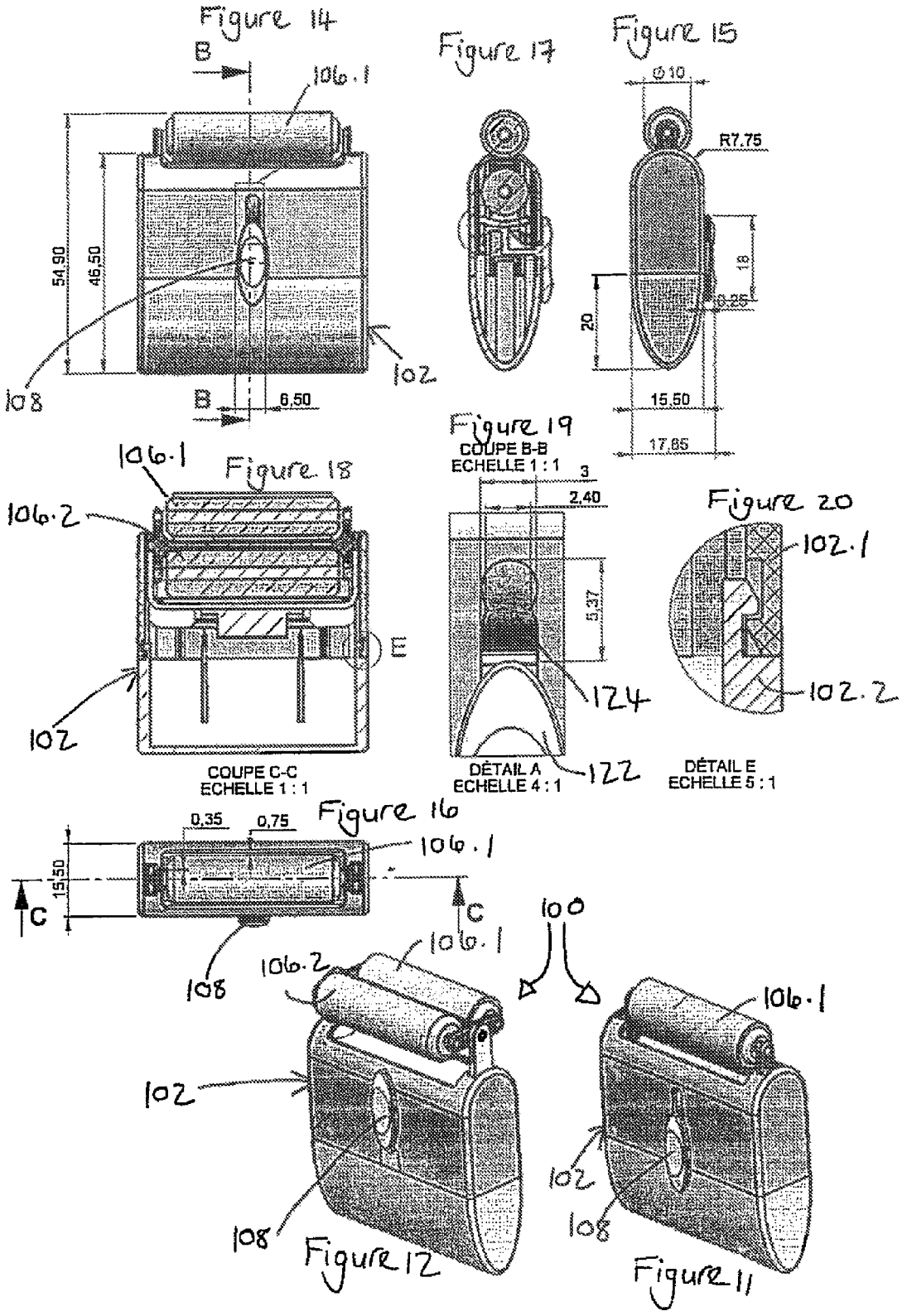
FIG. 11 shows a perspective view of a cosmetic product applicator according to a third embodiment, the applicator being shown in a retracted position.
FIG. 12 shows a perspective view of the cosmetic product applicator shown in FIG. 11, the applicator being shown in an extended and rotated position.
FIGS. 14 to 16 show top, front and side views, respectively, of the cosmetic product applicator shown in FIGS. 11 and 12.
FIGS. 17 and 18 show cross-sectional side and front views, respectively, of the cosmetic product applicator shown in FIGS. 11 and 12.
FIG. 19 shows detail 'A' shown in FIG. 14.
FIG. 20 shows detail 'E' shown in FIG. 18.
Figure 21:
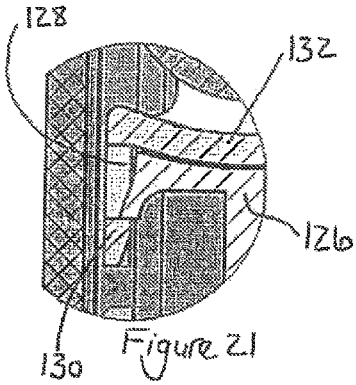
FIG. 21 shows detail 'D' shown in FIG. 17.

The applicator 100 further comprises an actuator 108 to move the applicator arrangement 104 from a retracted position, in which one of the application elements 106.1, 106.2 is accommodated within the housing 102, as shown in FIG. 11, and an extended position in which the application elements 106.1, 106.2 protrudes from the housing 102, as shown in FIG. 12. Thus, as described above, in the retracted position, only one of the application elements 106.1, 106.2 protrudes from the housing 102 for loading and application of the cosmetic product, with the remaining application element being accommodated within the housing 102 so as to fix the application arrangement 104 relative to the housing 102.

Figure 13:
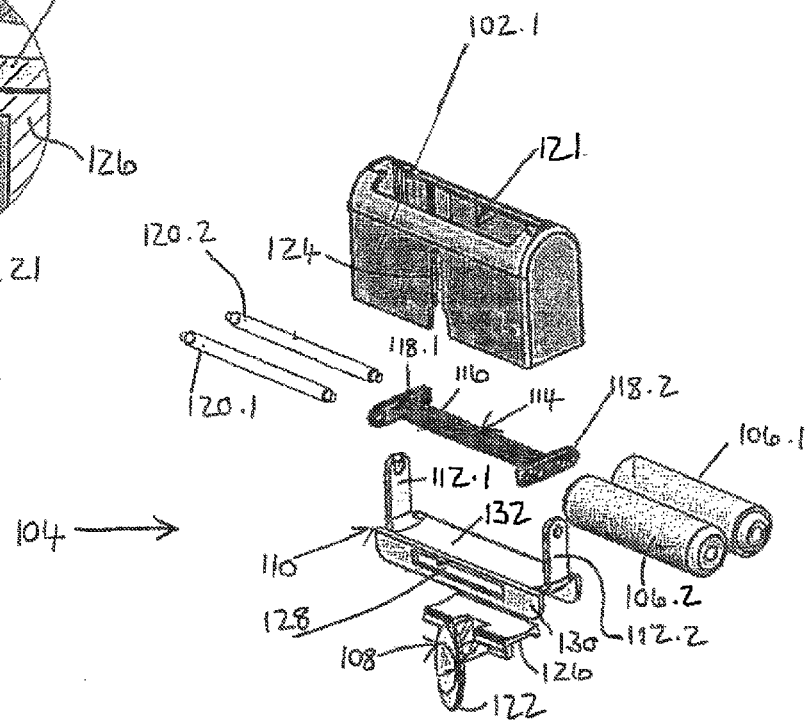
FIG. 13 shows an exploded, perspective view of the cosmetic product applicator shown in FIGS. 11 and 12.
Figure 13:
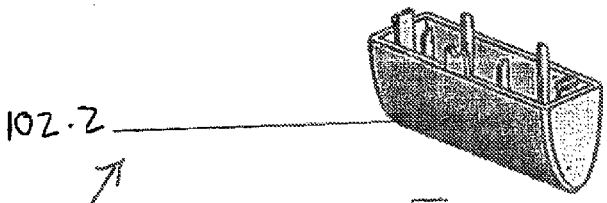

In an embodiment, as best shown in FIGS. 13, 17 and 18, the application arrangement 104 comprises a support structure 110 that can be slidably accommodated within the housing 102. The support structure 110 terminates in arms 112.1, 112.2.

The application arrangement 104 further comprises an I-shaped application element holder 114 rotatably fitted to a distal end of the support structure 110, and in particular to the arms 112.1, 112.2. The application element holder 114 can thus rotate between a first position, in which the application elements 106.1, 106.2 are in line with a plane defined by the housing 102, and a second position in which the application elements 106.1, 106.2 extend transversely relative to the housing 102, as shown in FIG. 12.

In the configuration shown in FIG. 12, the application elements 106.1, 106.2 can be used simultaneously to apply product. The application material of the application elements 106.1, 106.2 may be the same material or chosen from different materials. Such a configuration may advantageously allow a greater quantity of product to be applied during a single application gesture, in the case in which the application elements 106.1, 106.2 are loaded with the same product. Such a configuration may also be used to apply different products during a single application gesture, in the case in which the application elements 106.1, 106.2 are loaded with different cosmetic products.

In this regard, the holder 114 comprises a main support 116 and end support plates 118.1 and 118.2 that define apertures. The apertures in turn accommodate end stubs of stub axles 120.1, 120.2, to which the application elements 106.1, 106.2 are fitted. The application elements 106.1, 106.2 are thus rotatably connected to the application element holder 114, so that in the extended position, the application elements 106.1, 106.2 can rotate relative to the housing 102.

The housing 102 comprises a body portion 102.1 and a cap portion 102.2. These portions are arranged to snap fit together, as shown in FIG. 20. The body portion 102.1 defines an aperture 121 for allowing the application arrangement 104, and in particular the application elements, to move therethrough.

In an embodiment, the support structure 110 comprises a push button 122 that protrudes through an elongate slot 124 defined in a side wall of the body portion 102.1 of the housing 102. The push button 122 defines the actuator, so that that a user can move the application arrangement 104 between the retracted and extended positions by manipulating the push button 122. The push button 122 extends from a support base 126, the ends of which can clip into elongate slots 128 defined in flanges 130 extending from a base plate 132 of the support structure 110.

The invention claimed is:

1. An applicator for applying a cosmetic product on a person's skin, the applicator comprising:

a housing;

a first handle component; and an application arrangement connected to the first handle component, the application arrangement comprising a support that is rotatably fitted to the first handle component, and at least two application elements that are rotatably fitted to the support, wherein the at least two application elements are configured to be loaded with cosmetic product, and wherein the at least two application elements are configured to be brought selectively into contact with the person's skin to apply the cosmetic product, wherein the application arrangement is moveable relative to the housing from a first position, in which only one of the application elements protrudes from the housing for loading and application of the cosmetic product, with the remaining application elements being accommodated within the housing so as to fix the application arrangement relative to the first handle component, to a second position in which the application arrangement protrudes from the housing and the application arrangement is rotatable relative to the first handle component.

2. The applicator according to claim 1, wherein the support is rotatable relative to the first handle component about a first axis of rotation, and each of the application elements is rotatable relative to the support about a different axis of rotation, each different axis of rotation being parallel to the first axis of rotation.

3. The applicator according to claim 2, wherein the application elements are distributed around the first axis of rotation, with each different axis of rotation spaced apart from the first axis of rotation.

4. The applicator according to claim 2, wherein the application elements are arranged in a side by side configuration, with each different axis of rotation being parallel to each other.

5. The applicator according to claim 1, wherein the support is rotatably fitted to a distal end of the first handle component, thereby allowing a user to select which application element is to be loaded with cosmetic product for application to the person's skin.

6. The applicator according to claim 1, wherein the application arrangement comprises a pair of application elements.

7. The applicator according to claim 6, wherein, when the application arrangement is in the second position, the support is rotatable relative to the first handle component between a position in which the application elements are in line with a plane defined by the housing, and a position in which the application elements extend transversally relative to the housing and are simultaneously usable.

8. The applicator according to claim 1, wherein the application arrangement comprises three application elements.

9. The applicator according to claim 1, wherein the application arrangement also comprises:

an axle assembly configured to rotatably fit the application arrangement to the first handle component, the axle assembly terminating in a pair of end supports; and at least two application elements configured to be loaded with cosmetic product, the at least two application elements being rotatably fitted to the end supports.

10. The applicator according to claim 9, wherein the application elements are located on sides of the axle assembly, so as to be spaced apart by 180° from each other.

11. The applicator according to claim 9, wherein the application arrangement comprises three application elements spaced apart by 120° radially around the axle assembly.

12. The applicator according to claim 1, wherein the housing defines a second handle component that can be held by a user of the applicator.

13. The applicator according to claim 1, wherein each application element comprises a roller covered by an application material suitable for being loaded with cosmetic product and for transferring the cosmetic product to the skin during application.

14. The applicator according to claim 13, wherein the material of a first application element is different from the material of a second application element such that the first application element and the second application element are loadable with different cosmetic products.

15. The applicator according to claim 1, comprising an actuator for moving the application arrangement from the first position to the second position.

16. The applicator according to claim 15, wherein the actuator comprises a push button that protrudes through an aperture defined in a side wall of the housing.

17. The applicator according to claim 1, wherein the first handle component is slidably accommodated within the housing.

18. An applicator package for a cosmetic product, the applicator package comprising:

a container for storing at least one type of cosmetic product; and an applicator for applying a cosmetic product according to claim 1.

* * * * *